United States Patent [19]

Bloodworth

[11] 4,369,615

[45] Jan. 25, 1983

[54] ANIMAL HALTER

[76] Inventor: Darrell R. Bloodworth, Rte. 2, Box 217-A, Waller, Tex. 77484

[21] Appl. No.: 283,909

[22] Filed: Jul. 17, 1981

[51] Int. Cl.[3] ..... B68B 1/02

[52] U.S. Cl. ..... 54/24

[58] Field of Search ..... 54/6 R, 24; 119/96, 119/130

[56] References Cited

U.S. PATENT DOCUMENTS

| | | | |
|---|---|---|---|
| 366,972 | 7/1887 | Michaelis | 54/24 |
| 1,352,557 | 9/1920 | Stansbie | 54/24 |
| 1,570,225 | 1/1926 | Beckwith | 54/24 |
| 2,105,285 | 1/1938 | Hethcote | 54/24 |

*Primary Examiner*—Gene Mancene
*Assistant Examiner*—Robert P. Swiatek
*Attorney, Agent, or Firm*—Bill B. Berryhill

[57] ABSTRACT

An animal halter formed from a single length of rope comprising: an eye loop formed by a doubled portion of the rope, the opposite first and second parts of which are connected at a first point for disposition near one side of the lower jaw of an animal; a headstall loop formed by an extended and doubled portion of the first part; a noseband loop formed by extended and doubled portion of the second part, the extended portions of the first and second parts which form the headstall and noseband loops being connected at a second point for disposition near the other side of the lower jaw; and the first and second parts extending generally side by side from the second point for connection at a third point for disposition below the lower jaw of the animal and forming an elongated slot engaged by the bend of the eye loop to allow limited movement of the eye loop between the second and third points. At least one of the first and second parts may extend past the third point to provide a lead portion of the halter.

10 Claims, 2 Drawing Figures fig.1
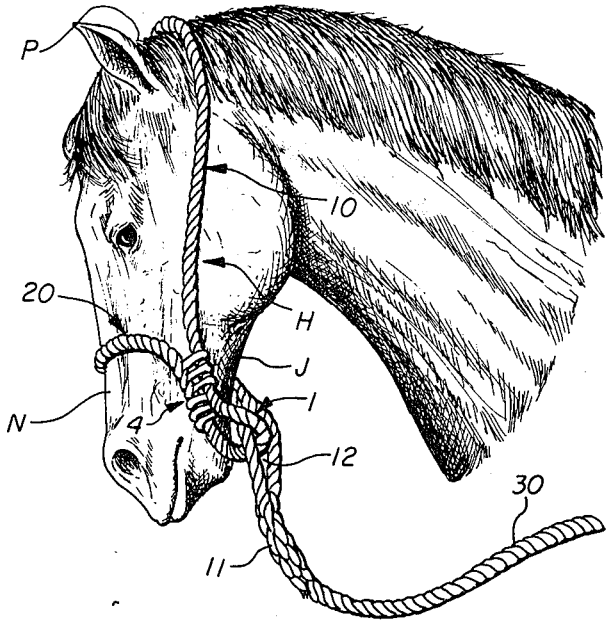
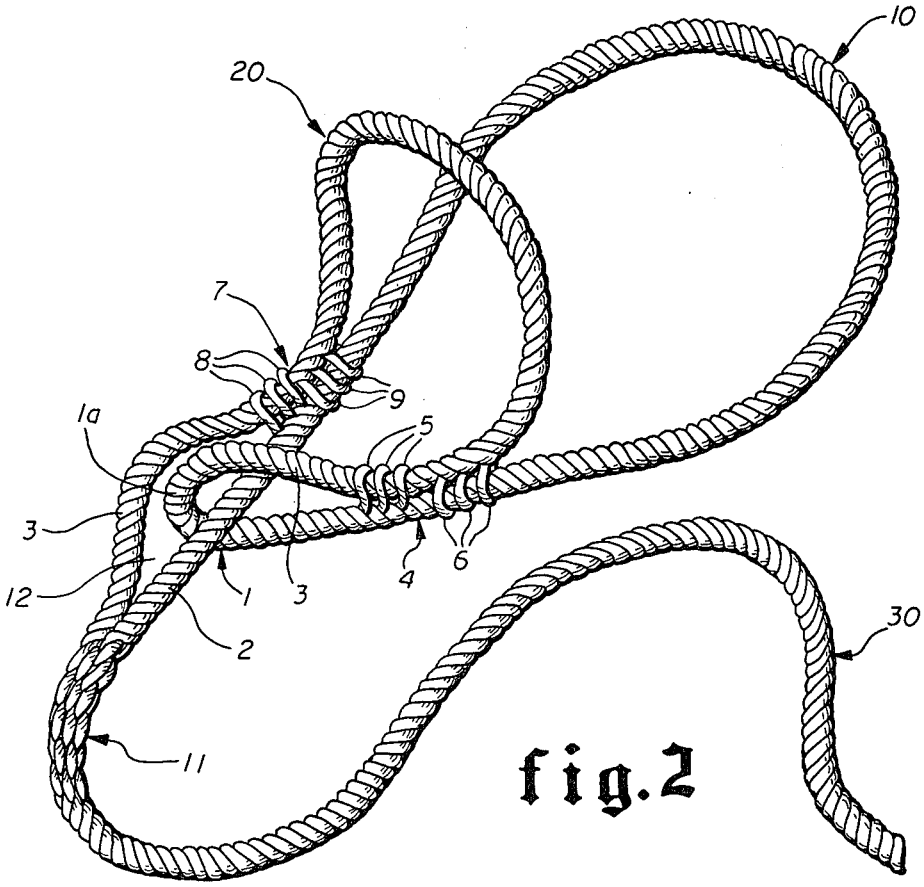
fig.2

ANIMAL HALTER

BACKGROUND OF THE INVENTION

1. Field of the Invention

The present invention pertains to animal halters. Specifically, the invention pertains to a halter, particularly suitable for horses, formed from a single length of rope.

2. Description of the Prior Art

Various types of halters have been developed over the years for fitting over the head of an animal. The halter may be generally left on the animal's head so that it can be easily caught or in the alternative, only placed on the animal when needed. The halter may be used simply to lead the animal from place to place, to show the animal, or, in some cases, to ride the animal.

A number of halters have been developed over the years, particularly for use with horses. Some of the more popular horse halters may be seen in U.S. Pat. Nos. 1,138,115; 1,747,012; and 3,949,538. Most of these halters are provided with a headstall loop, which encircles the horse's head in the poll region adjacent the ears, and a noseband loop which encircles the horse's nose in the region of the jaws. Some halters also provide a loop around the neck. To provide the necessary loops and connections between various portions of the halter, buckles, loops, links and the like may be provided. Many of these buckles, loops, links, etc. are made of metal. Since halters are normally exposed to the elements, these metal parts may rust and eventually fail. In addition, they may become heated by the sun or chilled in extremely cold weather, causing the horse to react in such a manner that the person placing the halter on the animal may be injured thereby.

To eliminate the use of metal parts, some halters are made totally of rope. An all-rope halter, primarily for use on cattle, is shown in U.S. Pat. No. 1,580,553. An all-rope halter referred to as the "adjustable halter" is shown in FIG. 191 and described on page 70 of Graumont's *Handbook of Knots,* published by Cornell Maritime Press, Cambridge, Maryland, 1945. While these all-rope halters are not subject to rusting and other adverse effects of the elements, they may have other disadvantages. For example, most of such halters have no limit on the tightness with which the headstall and/or noseband loop may be squeezed about the animal's head. This is particularly critical with horses which are easily excitable, and which may cause choking of the horse or breaking of its jaw, nose, or other member. In addition, some of these halters are susceptible to becoming loose and easily discardable by the animal simply by the shaking of its head.

SUMMARY OF THE PRESENT INVENTION

The present invention provides an animal halter which is formed from a single length of rope, eliminating the necessity of metallic parts or components. In addition, the halter of the present invention is adjustable for variable size animal heads. Furthermore, the halter of the present invention is limited in its tightness or looseness on the head of an animal, preventing injury to the animal from overtightness and preventing removal by the animal from overlooseness.

The animal halter of the present invention comprises: an eye loop formed by a doubled portion of a single length of rope, the opposite first and second parts of which are connected at a first point for disposition near one side of the upper jaw of the animal; a headstall loop formed by an extended and doubled portion of the first part; a noseband loop formed by an extended and doubled portion of the second part, the extended parts of the first and second parts which form the headstall and noseband loops being connected at a second point for disposition near the other side of the animal's lower jaw; and the first and second parts further extending generally side by side from the second point for connection at a third point for disposition below the lower jaw of the animal and forming an elongated slot for engagement by the bend of the eye loop to allow limited movement of the eye loop between the second and third points. At least one of the first and second parts may extend past the third point to provide a lead portion of the halter. The headstall and noseband loops may be connected at the first and second points by twist separations in each part of the rope and the first and second parts of the rope may be connected at the third point by splicing. The twist separation connections are unique, providing protuberances by which pressure may be applied to the jaw of the animal upon a force being applied to the lead portion of the halter.

The halter of the present invention is unique in several aspects. It is formed from a single length of rope, without the use of buckles, links or other components. It is adjustable for animals of different head sizes. It may be tightened for applying control pressure to the jaw and other portions of the animal's head, yet being limited in such tightening so as to prevent choking of the animal or injury to the nose, jaw or other members thereof. It is self-loosening when the animal is standing at ease yet cannot be loosened to the point that it is easily discarded by the animal. Many other objects and advantages of the invention will be apparent from reading the description which follows in conjunction with the accompanying drawings.

BRIEF DESCRIPTION OF THE DRAWINGS

FIG. 1 is a side elevation view of a horse, illustrating the use of a halter thereon, according to a preferred embodiment of the invention; and FIG. 2 is a pictorial representation of a halter, according to a preferred embodiment of the invention, better illustrating its construction.

DESCRIPTION OF THE PREFERRED EMBODIMENT

Referring first to FIG. 1, a rope halter H, according to a preferred embodiment of the invention, is shown fitted about the head of a horse. Although the halter H is primarily designed for horses, it can be used with cattle or other animals. The halter H comprises a headstall loop 10 which encircles the head in the poll region P of the horse adjacent its ears, a noseband loop 20 encircling the nose and jaw regions N and J and a lead portion 30.

Referring also to FIG. 2, a fuller understanding of the halter and its construction will be seen. The halter H is made from a single length of rope and comprises an eye loop 1 formed by a doubled portion of the rope, the opposite first and second parts 2 and 3 of which are connected at a first point 4. The connection point 4 is referred to as a twist separation and is unique. To understand such, it should first be understood that the rope is of a plurality of strands, three in the exemplary embodiment. Each strand of the first part 2 is separated and twisted to form a first series of circular loops through which the second part 3 passes. Likewise, each strand of the second part 3 is separated and twisted to form a second series of circular loops 6 adjacent the first series of circular loops 5 and through which the first part 2 passes. The engagement of the nearest of the circular loops 5 and 6 prevents slipping of the rope parts 2 and 3 relative to each other. These twist separations loop series 5 and 6, at the point of connection 4, will be disposed, as best seen in FIG. 1, near one side of the lower jaw of the animal.

The headstall loop 10 is formed by an extended and doubled portion of the first part 2. The noseband loop is formed by an extended and doubled portion of the second part 3. The first and second parts of the rope are connected at the opposite ends of the headstall loop 10 and noseband loop 20 at a second point 7 for disposition near the other side of the animal's lower jaw. This second connection point 7 may be accomplished by twist separations as previously described at the first point 4. The strands of the first part 2 are separated and twisted to form a first series of circular loops 8 corresponding with the first series of loops 5 at the first point 4. The second part of the rope passes through this first series of circular loops 8. The strands of the second part 3 are separated and twisted to form an adjacent second series of circular loops 9, corresponding with the second series of loops 6 at the first point 4. The first part 2 of the rope extends through the second series of circular loops 9.

The first and second parts 2 and 3 of the rope extend generally side by side from the second point 7 for connection at a third point 11. This connection may be made by a standard splice, the first part 2 extending past the point 11 as the standing part to form the lead portion 30 of the halter.

The first and second rope parts 2 and 3 between the second point 7 and the third point 11 define an elongated slot 12 which is engaged by the bend 1*a* of the eye loop 1. Thus, the eye loop 1 is allowed limited movement in the elongated slot 12 between the second point 7 and the third point 11. Although the first and second rope parts 2 and 3 are generally side by side, one of the parts, the second part 3 in the exemplary embodiment, may be slightly longer so as to create a more open slot 12.

Since the eye loop 1 is allowed to move within the elongated slot 12, the headstall loop 10 and noseband loop 20 are adjustable for placement on animals with varying head sizes. Once in place on the animal as illustrated in FIG. 1, the horse can be lead or tied by the lead portion 30. If the horse resists leading or tying, a force is applied at the third point 11 below the lower jaw of the animal. When this occurs, the headstall loop 10 attempts to assume a V-shaped disposition near the first and second points 4 and 7. Since the series of circular loops 5, 6, 8 and 9 form protuberances at these points, pressure is placed on the jaw of the animal, generally at the first and second points 4 and 7. Such pressure tends to control the animal to follow the lead of the handler or to assume a standing position when tied. Because the second connection point 7 and the third connection point 11 limits movement of the eye loop 1 within the elongated slot 12, the headstall loop 10 and noseband loop 20 are of predetermined minimum and maximum circumferences. Thus, there is no danger that these loops will be tightened to such an extent as to choke or injure the animal. Conversely, there is a limit to the looseness of the halter so that it may not be easily removed by the animal shaking its head or rubbing against a fixed obstacle.

The halter of the present invention has a number of unique points. It is made of a single length of rope without buckles, links or other components. Thus, there are no components to be rusted or affected by the elements. The halter is adjustable for various sized animals. In addition, it has predetermined limits of tightness and looseness, alleviating injury problems associated with other types of halters and preventing removal by the animal. The unique twist separations provide points of connection without additional straps, ropes or cording and without the possibility of slipping. In addition, these twist separations provide protuberances which are effective in applying pressure to the lower jaw of the animal when necessary for control.

A single embodiment of the invention has been described herein. However, variations of the halter can be made by adapting the basic construction. For example, a neck loop could be attached to the headstall loop. Other variations of the invention can be made without departing from the spirit of the invention. Accordingly, it is intended that the scope of the invention be limited only by the claims which follow.

I claim:

1. An animal halter formed only from a single length of rope and without other components comprising:

an eye loop formed by a double portion of said rope, the opposite first and second parts of which are connected at a first point for disposition near one side of the lower jaw of an animal;

a headstall loop formed by an extended and doubled portion of said first part;

a noseband loop formed by an extended and doubled portion of said second part, said extended first and second parts which form said headstall and noseband loops being connected at a second point for disposition near the other side of said lower jaw; and said first and second parts further extending generally side by side from said second point for connection at a third point for disposition below the lower jaw of said animal forming an elongated slot engaged by the bend of said eye loop to allow limited movement of said eye loop between said second and third points and consequent limited adjustment of said headstall and nose band loops.

2. An animal halter as set forth in claim 1 in which at least one of said first and second parts extends past said third point to provide a lead portion of said halter.

3. An animal halter as set forth in claim 1 in which said rope is of a plurality of strands, said connections at said first and second points being made by separating and twisting each strand of said first part to form a first series of circular loops through which said second part passes and by separating and twisting each strand of said second part to form a second series of circular loops adjacent said first series of circular loops through which said first part passes.

4. An animal halter as set forth in claim 3 in which said first series of loops are disposed nearer said third point than said second series of loops.

5. An animal halter as set forth in claim 3 in which said third point connection is made by splicing said first and second parts together.

6. An animal halter as set forth in claim 1 in which said third point connection is made by splicing said first and second parts together.

7. An animal halter as set forth in claim 1 which when placed on the head of said animal with a force applied to said third point attempts to assume a "V" shaped disposition near said first and second points placing pressure on the jaw of said animal at said first and second points.

8. An animal halter formed only from a single length of rope and without other components comprising:

an eye loop formed by a doubled portion of said rope, the opposite first and second parts of which are connected by twist separations in each part at a first point for disposition near one side of the lower jaw of an animal;

a headstall loop formed by an extended and doubled portion of said first part;

a noseband loop formed by an extended and doubled portion of said second part, said extended first and second parts which form said headstall and noseband loops being connected at the ends of said headstall and noseband loops by twist separations in each part at a second point for disposition near the other side of said lower animal jaw;

said first and second parts further extending generally side by side from said second point for spliced connection at a third point for disposition below the lower jaw of said animal and forming an elongated slot engaged by the bend of said eye loop to allow limited movement of said eye loop between said second and third points and consequent limited adjustment of said headstall and noseband loops; and at least one of said first and second parts extending still further past said third point to provide a lead portion of said halter.

9. An animal halter as set forth in claim 8 in which said twist separations at said first and second points are made by separating and twisting each strand of said first part to form a first series of circular loops through which said second part passes and by separating and twisting each strand of said second part to form a second series of circular loops adjacent said first series of circular loops through which said first part passes, said twist separations forming protuberances at said first and second points for applying pressure to each side of said animal's jaw upon a force being applied to said lead portion of said halter.

10. An animal halter as set forth in claim 8 in which said headstall loop is of a predetermined minimum circumference when said eye loop bend is at the end of said elongated slot nearest said second point and of a predetermined maximum circumference when said eye loop bend is at the opposite end of said elongated slot nearest said third point.

* * * * *